US006832562B2

(12) United States Patent
Tabor et al.

(10) Patent No.: US 6,832,562 B2
(45) Date of Patent: Dec. 21, 2004

(54) SHIPPING CONTAINER

(75) Inventors: Kurt F. Tabor, Royal Oak, MI (US); Kent L. Tabor, Royal Oak, MI (US); Keith S. Tabor, Ferndale, MI (US)

(73) Assignee: Packaging Specialties, Inc., Warren, MI (US)

( * ) Notice: Subject to any disclaimer, the term of this patent is extended or adjusted under 35 U.S.C. 154(b) by 169 days.

(21) Appl. No.: 10/079,387

(22) Filed: Feb. 20, 2002

(65) Prior Publication Data

US 2002/0113068 A1 Aug. 22, 2002

Related U.S. Application Data

(60) Provisional application No. 60/270,085, filed on Feb. 20, 2001.

(51) Int. Cl.[7] ..... B65D 19/00

(52) U.S. Cl. ..... 108/55.1; 108/51.3

(58) Field of Search ..... 108/51.3, 55.1, 108/165; 206/386, 599, 600; 220/1.5; 229/122, 198.2, 920

(56) References Cited

U.S. PATENT DOCUMENTS

| | | | | | |
|---|---|---|---|---|---|
| 3,480,196 | A | * | 11/1969 | De Simas | 206/598 |
| 3,519,190 | A | * | 7/1970 | Achermann et al. | 206/599 |
| 4,090,659 | A | * | 5/1978 | Galmiche et al. | 229/103.11 |
| 5,138,956 | A | * | 8/1992 | Rushbrook et al. | 108/107 |
| 5,324,105 | A | | 6/1994 | Christensen | 312/25 |
| 5,642,923 | A | | 7/1997 | Meacham et al. | 312/47 |
| 5,667,090 | A | | 9/1997 | Langham, Jr. et al. | 220/65 |
| 5,673,791 | A | | 10/1997 | Jamison | 206/65 |
| 5,702,011 | A | * | 12/1997 | Carroll | 211/135 |
| 5,794,542 | A | * | 8/1998 | Besaw | 108/51.3 |
| 5,833,114 | A | * | 11/1998 | Linnell | 220/531 |
| 6,041,718 | A | * | 3/2000 | Brandes et al. | 108/51.3 |
| 6,220,462 | B1 | | 4/2001 | Brockman et al. | 211/47 |
| 6,296,133 | B1 | * | 10/2001 | Cobane | 220/6 |
| 6,581,769 | B2 | * | 6/2003 | Nist | 206/386 |
| 6,612,669 | B2 | * | 9/2003 | Grueneberg | 312/259 |

FOREIGN PATENT DOCUMENTS

WO 91/14631 * 10/1991

* cited by examiner

*Primary Examiner*—Jose V. Chen
(74) *Attorney, Agent, or Firm*—L. C. Begin & Associates, PLLC

(57) ABSTRACT

A container (10) for stackable articles includes a base assembly (20), a plurality of side assemblies (30), a top assembly (70), and a plurality of shelf assemblies (50). The base assembly (20), side assemblies (50), and top assembly (70) are preferably constructed of a multiple layer, corrugated laminate, and are attachable to one another, defining an interior storage space (45). Each shelf assembly (50) includes a plurality of shelf support blocks (52) with a plurality of face sections (53) distributed along a length (37), and a shelf flap (54). The shelf assemblies (50) are secured to the sidewall assemblies (30), and positioned in the storage space (45) to engage manufactured articles, for example sunroofs, positioned therein.

17 Claims, 4 Drawing Sheets

Figure 1
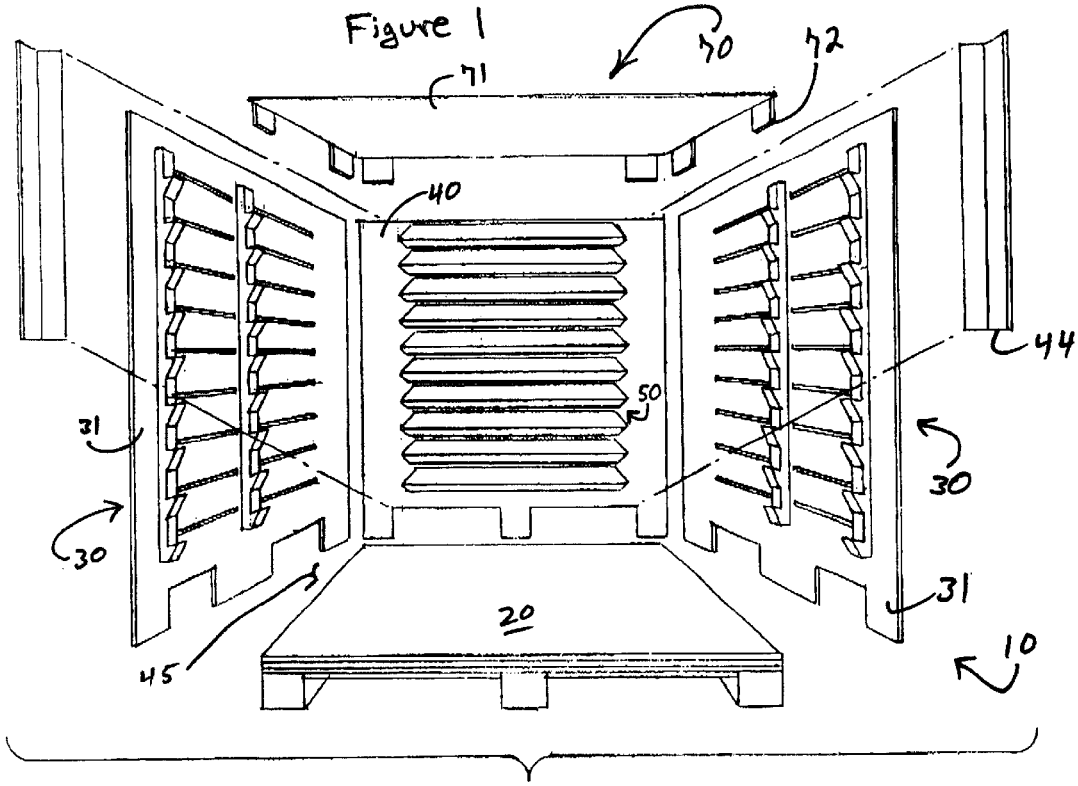
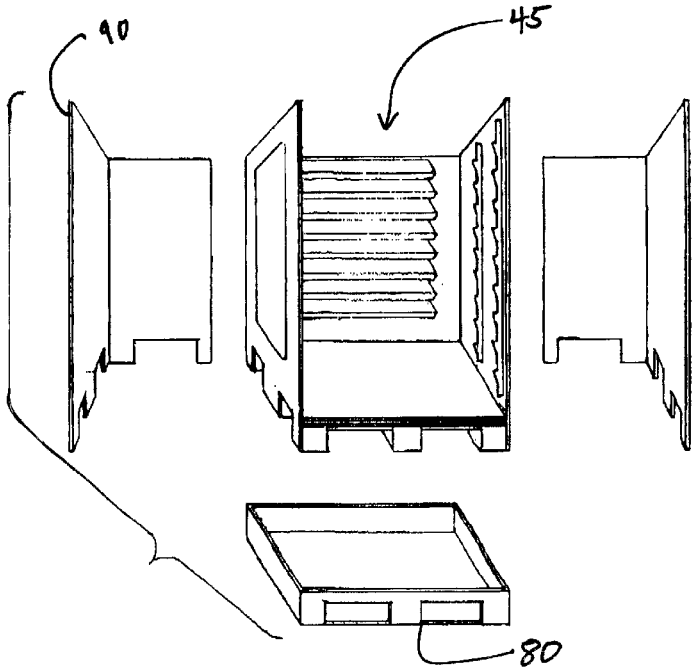
Figure 2

SHIPPING CONTAINER

This application claims the benefit of the filing date of U.S. Provisional Application, Ser. No. 60/270,085, filed Feb. 20, 2001.

TECHNICAL FIELD

The present invention relates generally to shipping and storage containers, and more particularly to such a container with an integral shelf assembly.

BACKGROUND OF THE INVENTION

Many different shipping container designs have been developed over the years, some having relatively elaborate interior shelf and article-positioning systems. One such example is found in U.S. Pat. No. 5,667,090 to Langham et al., which discloses an octagonal shipping container for shipping stackable manufactured articles. The Langham container includes a plurality of attached slotted wall panels defining an interior storage cavity. Langham further discloses a plurality of shelf arms which project through the slots to engage goods positioned in the storage cavity. Langham represents one method of storing and shipping stackable manufactured articles, in particular steering wheels. However, there is always room for improvement. For instance, the Langham container must be laid on its side upon a support fixture for loading, necessarily increasing the time and effort required to place articles into, or remove them from, the container. Further, Langham requires a separable fastener to secure the sides of the container.

It is thus desirable to construct a container for stackable goods that can be easily assembled and loaded, yet is strong and durable. The present invention addresses one or more of the limitations or problems associated with the related art.

SUMMARY OF THE INVENTION

In one aspect, the present invention provides a container for shipping and storing manufactured articles. The container includes a container body with a base assembly and a plurality of wall assemblies. Each of the plurality of wall assemblies includes a wall panel with a lower edge attached to the base assembly and at least one lateral edge joined to an adjacent wall panel. A plurality of shelf assemblies are also provided which are secured to the wall assemblies and protrude into an interior of the container body. Each of the plurality of shelf assemblies includes at least one shelf support block and at least one shelf flap having a support surface. The at least one shelf flap is attachable to said at least one shelf support block, thereby engaging the support surface with face section located on the at least one shelf support block.

In another aspect, a shelf assembly is provided. The shelf assembly includes at least one shelf support block having a plurality of notches positioned along a length. Each of the plurality of notches includes a substantially planar face region. A panel is also provided which defines a plurality of lateral slots, the slots being arranged in at least two substantially parallel columns. A foldable shelf flap is provided having a first surface which is a support surface having a central channel and a second surface also having a central channel. A plurality of foldable tabs are attached to the support surface and the second surface, each of the plurality of foldable tabs are insertable through the lateral slots, thereby positioning the shelf flap such that the at least one shelf support block is at least partially positioned within the central channels such that the substantially planar face region abuts the support surface.

In still another aspect, a shipping container with an integral interior shelf assembly is provided. The shipping container includes a container base and a plurality of attached wall members, each of the wall members having a bottom edge affixed to an exterior side of the container base. As attached, the container base and the wall members define an interior storage cavity. Additionally, a front wall assembly is provided having a front wall panel with at least one attached positioning block and left and right flap sections connected to the front wall panel, the left and right wall sections being securable to the container body. At least two shelf assemblies are provided, each having a plurality of shelf flaps mounted in part to one of the wall members, and also in part to at least one shelf support block. Each of the plurality of shelf flaps has a support surface in substantially flush engagement with a face on the at least one shelf support block.

BRIEF DESCRIPTION OF THE DRAWINGS

FIG. 1 is a partial exploded view of the present invention in accordance with a preferred embodiment;

FIG. 2 is a view of the present invention similar to FIG. 1;

DETAILED DESCRIPTION

Figure 3:
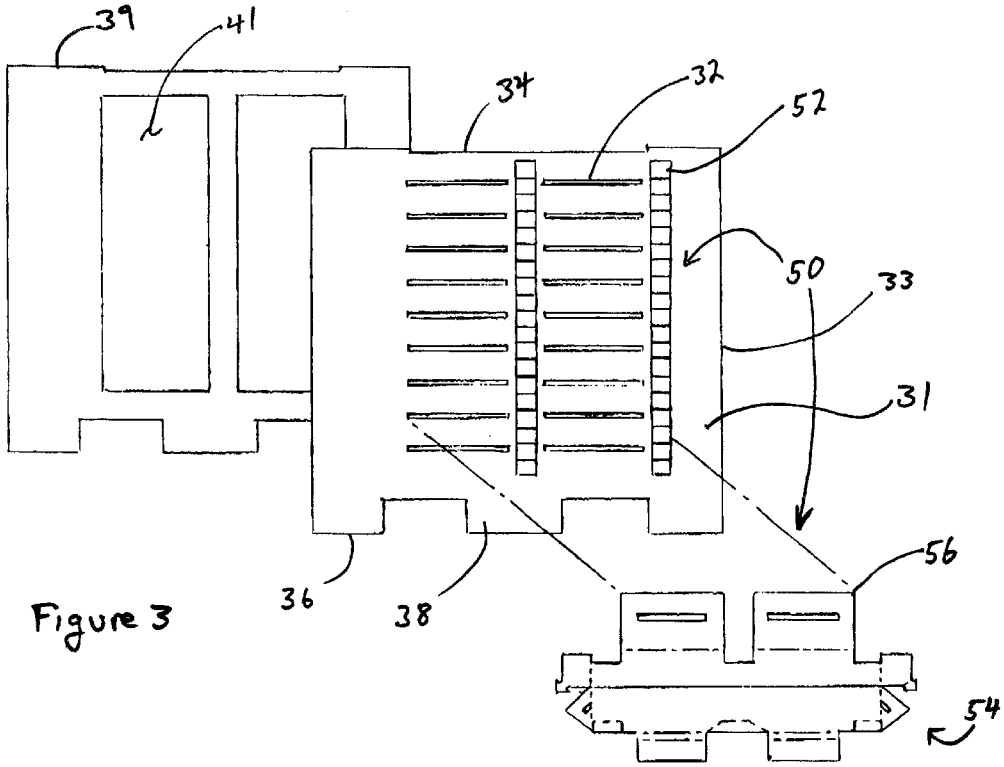
FIG. 3 is an exploded view of a side panel assembly in accordance with the present invention.

Referring to FIGS. 1 and 2, there are shown partial exploded views of a shipping container 10 according to a preferred embodiment of the present invention. Shipping container 10 includes a base assembly 20, and preferably includes a top assembly 70. A plurality of wall assemblies is also provided, including a front wall assembly 60, two substantially similar left and right wall assemblies 30, and a rear wall assembly 40. All of the wall assemblies are preferably constructed of corrugated laminates. The left and right sidewall assemblies 30, rear wall assembly 40, and front wall assembly 60 are all attachable to base assembly 20 with hot melt glue and/or staples in a manner known in the art, and define an interior storage space 45 when assembled. In a preferred embodiment, a plurality of shelf assemblies 50 are provided which are attachable to sidewall assemblies 30 and to rear wall assembly 40, and project into storage space 45. Manufactured articles may be safely positioned on the shelf assemblies 50 for storage and/or shipping. Two corner posts 44, which are L-shaped in cross-section and constructed of corrugated laminates, are preferably glued to the rear corners of container 10, and join the sidewall assemblies 30 to the rear wall assembly 40.

Figure 7:
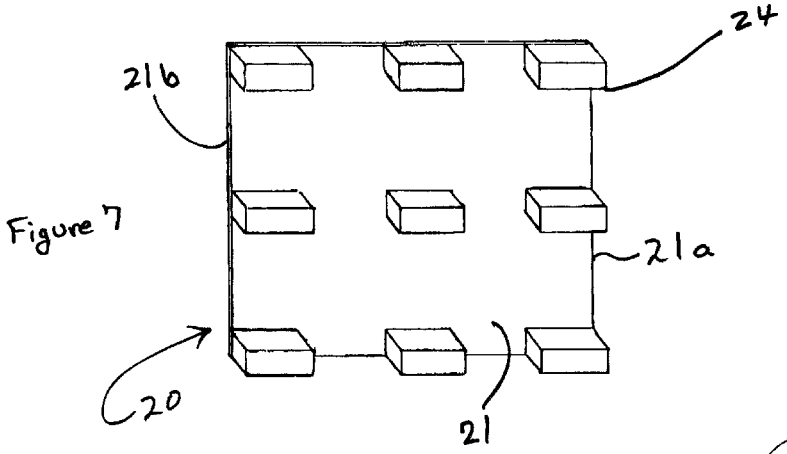
FIG. 7 is a bottom view of a base assembly in accordance with the present invention.

Referring to FIG. 7, there is shown a bottom view of base assembly 20. Base assembly 20 includes a bottom panel 21, preferably constructed of multiple layers of corrugated laminations, although it should be appreciated that some other suitable material such as plywood might be substituted. Base assembly 20 also includes a plurality of laminated build-up blocks 24, which lend support to the entire container 10, and are fitted into complementary die cuts through at least one ply of the corrugated laminations. A preferred embodiment provides nine blocks, with those blocks underlying the middle of container 10 being larger than the blocks positioned at the front 21*a* and the back 21*b* of base assembly 20. Spacing between the blocks is preferably sufficient to allow insertion of a conventional forklift's tines between the blocks. Returning to FIG. 2, a corrugated reinforcing band member 80 can optionally be glued to the sides of base assembly 20 for added reinforcement.

Figure 4:
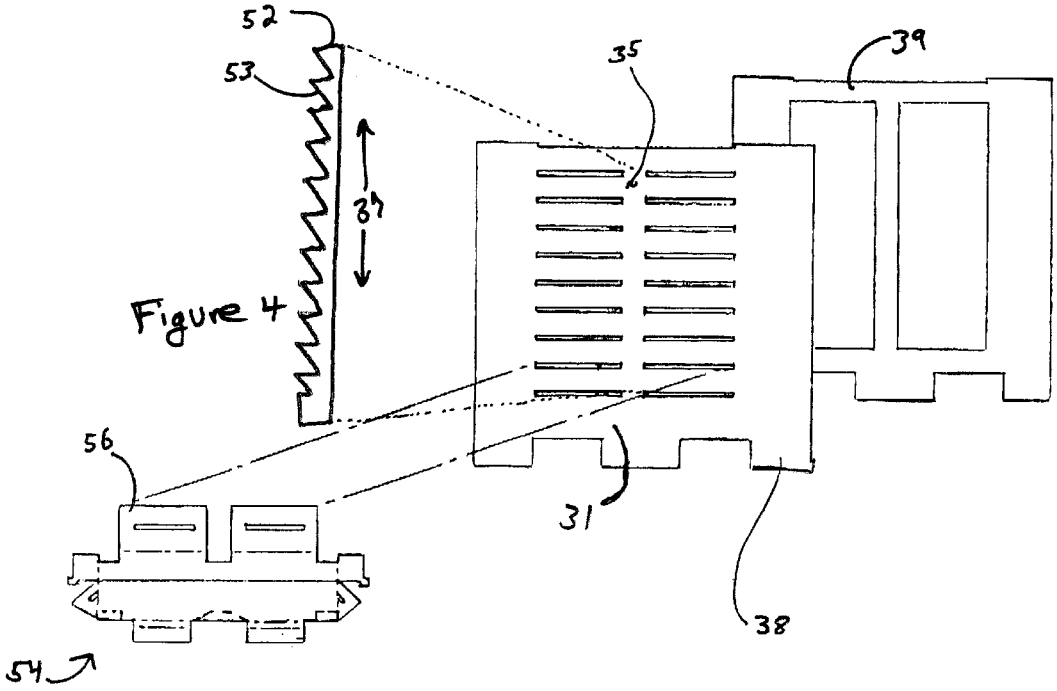
FIG. 4 is an exploded view of a side panel assembly in accordance with the present invention.
Figure 5:
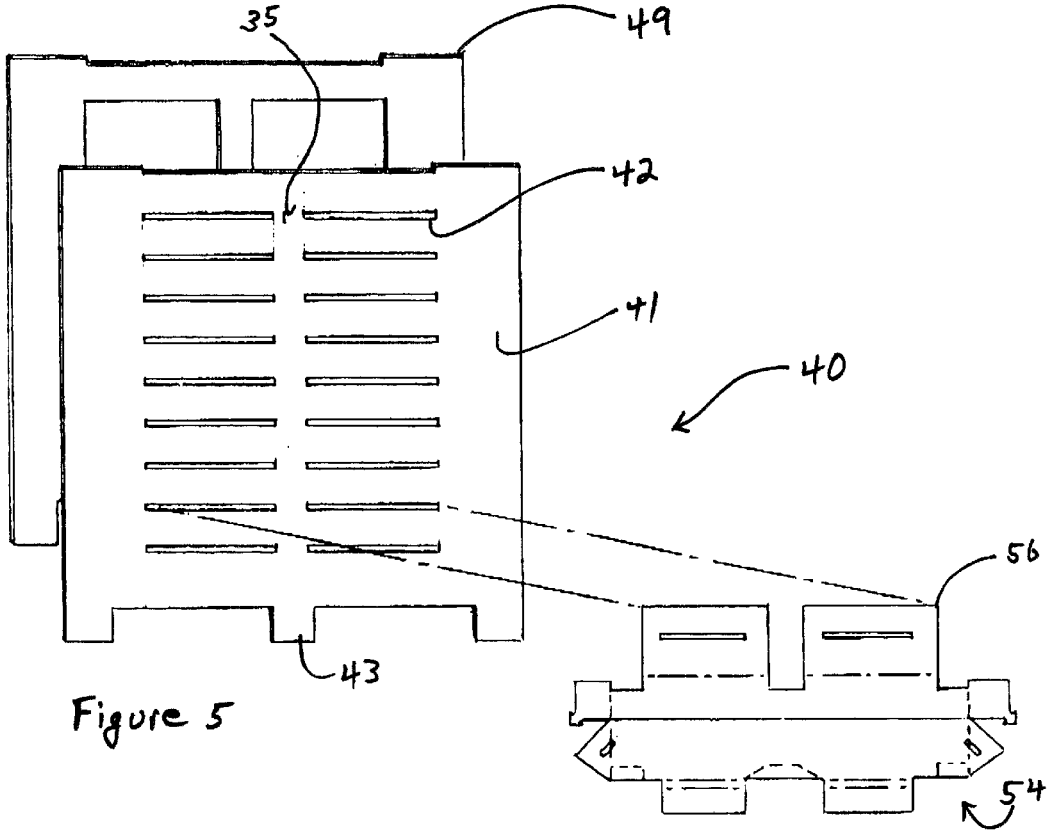
FIG. 5 is an exploded view of a back panel assembly and an unfolded shelf flap in accordance with the present invention.

Referring now to FIGS. 3 and 4, there are shown exploded views of respective right and left sidewall assemblies 30 according to a preferred embodiment of the present invention. FIG. 3 illustrates the shelf support blocks 52 in an installed position, whereas FIG. 4 includes a shelf support block 52 shown un-installed. Each of the sidewall assemblies 30 includes a sidewall panel 31, which is preferably constructed of multiple corrugated laminations. Panels 31 each have a top edge 34 and a bottom edge 36. Bottom edge 36 preferably has a plurality of depending tabs 38 which may be attached to base assembly 20 (See FIGS. 1 and 2) with hot melt glue and/or staples in a conventional manner. Panels 31 define a plurality of lateral slots 32, which are arranged in two vertical columns on each panel in a preferred embodiment. A support panel 39 is provided for each side, and is preferably laminated to the exterior of each sidewall panel 31, imparting additional structural integrity to the container 10 and the shelf assemblies 50 when assembled. Support panels 39 are preferably roughly the same shape as sidewall panels 31, however, two substantially rectangular openings or spaces 41 corresponding to the two columns of lateral slots 32 in side panels 31 are cut from support panels 39. Thus, when a support panel 39 is affixed to a sidewall panel 31, the slots 32 remain open to either side of the panel. Referring to FIG. 5, there is shown an exemplary rear wall assembly 40. Similar to sidewall assemblies 30, rear wall assembly 40 includes a back wall panel 41 with a plurality of downwardly projecting tabs 43, which can be used to secure panel 41 to base assembly 20 in a conventional manner. Panel 41 defines two columns of lateral slots 42, and can be secured to a support panel 49 in a manner similar to that described with respect to side panels 31 and support panels 39. An alternative embodiment might include a hinged support panel(s) that could be simultaneously attached to both the sidewalls and the rear wall of the container in a wraparound fashion.

FIG. 3 also illustrates an exploded portion of a shelf assembly 50. When container 10 is fully constructed, a shelf assembly 50 is preferably attached to each sidewall assembly 30, and to rear wall 40. In an alternative embodiment, the shelf assemblies may be attached only to the container's sidewalls, and not to the rear of the container. Such an embodiment would find utility where the present invention is used to store and/or ship flat articles such as sheets of glass, needing lateral support but not requiring support at either end. Additional alternatives might have shelf assemblies attached to two or more walls of a triangular container body, or to all four walls of a rectangular container body. Each shelf assembly 50 includes a plurality of shelf support blocks 52, preferably two such blocks, each having a plurality of notch sections 53 serially distributed along the length 37 (see FIG. 4) of the block 52. The sections 53 are preferably a substantially flat face, and are oriented substantially parallel with respect to bottom panel 21 of container 10, although it should be appreciated that face section 53 might be angled either up or down without departing from the scope of the present invention. Shelf support blocks 52 are preferably constructed of multiple layers of corrugated laminates, however, they might also be made from wood or some other suitably rigid material. In a preferred embodiment, the shelf assemblies 50 attached to the sidewalls 30 each include two shelf support blocks 52, whereas the shelf assembly attached to the rear wall 40 does not include shelf support blocks 52. Although a total of four shelf support blocks in container 10 are illustrated in the attached drawings, this is merely the preferred number, and is not necessarily the required, nor even the optimum number. By varying the number and positioning of the shelf support blocks, container 10 could be used to store manufactured articles of a great variety of shapes, weights, and sizes. The two shelf support blocks 52 are preferably attached at a position adjacent a front edge 33 of each side wall panel 31 corresponding to the front of container 10, and at a position between the columns of lateral slots 32 on an un-slotted island 35 (see FIG. 4).

Figure 8:
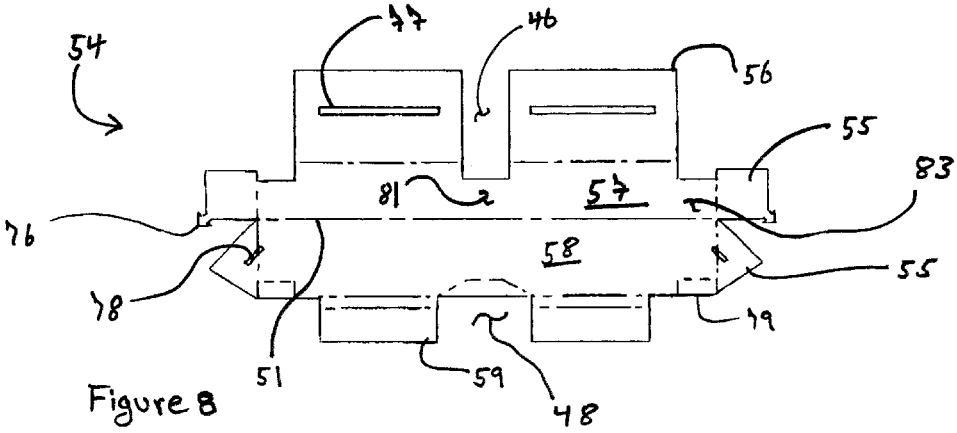
FIG. 8 is a front view of a shelf flap in accordance with the present invention.

Referring now to FIG. 8, there is shown a flattened (unfolded) shelf flap 54 as used in the preferred construction of each shelf assembly 50 in container 10. Each shelf flap 54 is preferably constructed of multiple corrugated laminations, however, some other material such as a flexible, non-corrugated material might be employed. Each shelf flap 54 has an upper surface 57 and a lower surface 58, separated by a central fold line 51. Upper surface 57 has a plurality of attached foldable upper tabs 56 that, with upper surface 57, define a first channel 46. Lower surface 58 has a plurality of attached foldable lower tabs 59 that, with lower surface 58, define a second channel 48. In a preferred embodiment, upper surface 57 and lower surface 58 each have a set of foldable end tabs 55, which are preferably glued to each other when shelf flap 54 is in a fully folded conformation, and are securable by inserting a barbed tab 76 into a slot 78. With end tabs 55 thus secured, each shelf flap 54 is roughly triangular in an end-view cross section, with closed ends (not shown). In a preferred embodiment, the end tabs 55 attached to shelf support surface 57 slope slightly downward with respect to support surface 57 when the shelf is fully constructed, facilitating loading of articles into container 10. A small foldable rectangular section 79 is preferably included on shelf flap 54, and can fold slightly outward to accommodate a shelf support block 52, as described below.

Referring again to FIGS. 3 and 4, as well as to FIG. 8, when construction of a shelf assembly 50 from its component parts is desired, four shelf support blocks 52 are glued to the side panels 31 at appropriate positions, as previously described. The shelf assembly 50 positioned along rear wall 40 is preferably constructed without shelf support blocks, although they might be included if desired. Lower shelf tabs 59 of shelf flap 54 are then inserted into the lowermost set of horizontal slots 32, 42, on a panel 31, 41, and are thenceforth folded and secured to the outside of the panel 31, 41. Second channel 48 thus partially encloses the associated shelf support block 52, which is attached to the panel along un-slotted island 35. It should be appreciated that the order and manner in which the various component parts are assembled might be varied considerably without departing from the scope of the present invention. For instance, it might be desirable to place articles into container 10 before the entire shelf assembly is completed. Alternatively, container 10 might be used to store or ship articles of multiple different sizes, making different shelf dimensions and number, and thus a different order of component assembly, desirable.

Figure 9:
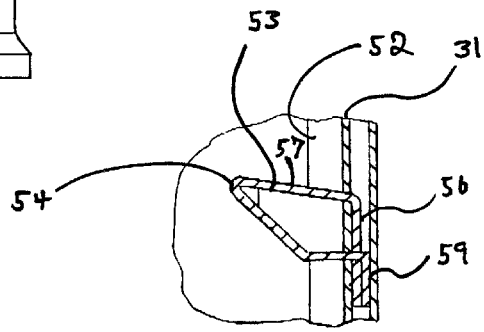
FIG. 9 is a partial sectioned side view of a shelf assembly according to the present invention.

Once shelf tabs 59 are secured to panels 31, 41, shelf flap 54 may be folded up around the two shelf support blocks 52, preferably bringing the upper surface 57 of each shelf flap 54 into contact with the face sections 53, and bringing the shelf support block 52 partially within first channel 46. Upper tabs 56 are inserted into the next set of lateral slots 32, 42, folded down, and secured to the outside of the panel 31, 41. In a preferred embodiment, lower shelf tabs 59 are inserted through complementary slits 77 in upper shelf tabs 56. In this fashion, face sections 53 abut upper surface 57 at two positions, in an area 81 of upper surface 57 that is adjacent first channel 46, as identified in FIG. 8, and at an anterior end 83 of surface 57. FIG. 9 illustrates a sectioned side view of a shelf flap 54, showing the flush engagement of support surface 57 with face section 53, and also illustrating the folded engagement of upper tabs 56 with lower tabs 59.

The assembly process is repeated with as many shelf flaps as necessary to install the desired number of shelf assemblies. Once the shelf assemblies are secured, a sheet or sheets of corrugated laminate (not shown) should be glued and stapled to the outer surfaces of the sidewalls, to cover and protect the shelf assembly tabs 56 and 59. The described procedure is followed for both sidewalls 30 and for rear wall 40 (if support blocks are not used, then a similar procedure is followed with the omission of the blocks), until the desired number of shelves has been installed. Once installation of the shelf assemblies is complete, the articles to be stored in container 10 may be loaded through the front of container 10 and positioned on the individual shelf units. The present invention substantially decreases the time required to load the container as compared to earlier designs, and obviates the requirements for pre-loading packaging of the articles themselves. After loading the manufactured articles into the container, front wall assembly 60 and top assembly 70 are attached to container 10, as described below.

Figure 6:
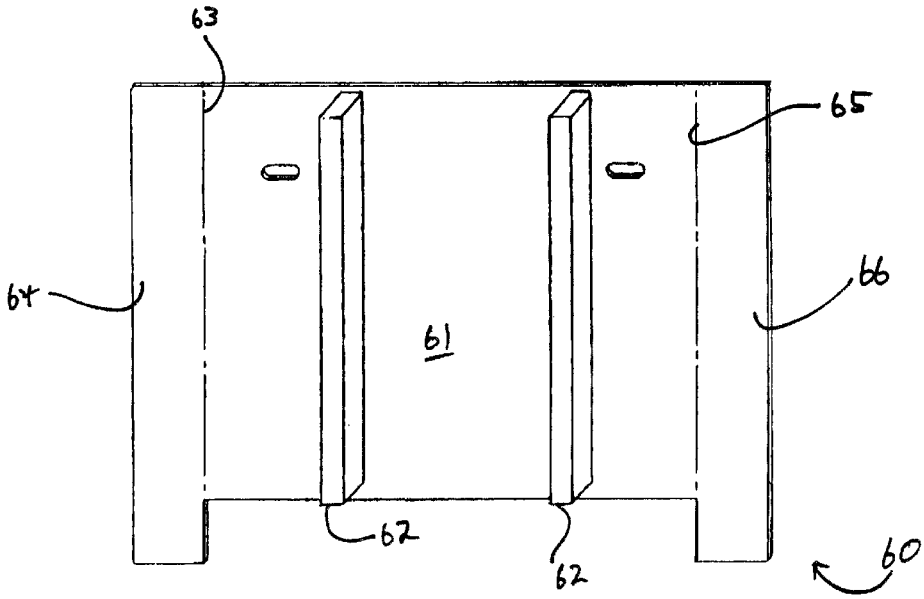
FIG. 6 is a rear view of a front wall assembly in accordance with the present invention.

Referring to FIG. 6, there is illustrated front wall assembly 60. Front wall assembly 60 includes a front wall panel 61, a left wall flap 64, a right wall flap 66, and a plurality of positioning blocks 62. A left fold line 63 separates left wall flap 64 from front wall panel 61, whereas a right fold line 65 separates right wall flap 66 from front wall panel 61. Left wall flap 64 and right wall flap 66 are preferably foldable along the fold lines 63, 65 to bring the flaps into contact with left and right wall panels 31, to which they may be secured in a conventional manner. When front wall assembly 60 is secured to container 10, positioning blocks 62 protrude into the interior 45 of container 10, bringing them into contact with articles positioned within storage space 45. Positioning blocks 62 can thus positively stabilize goods within container 10 during shipping, transport, or storage. It should be appreciated that the dimensions of positioning blocks 62 may be varied to accommodate different sized articles, further enhancing container 10's versatility. Further, positioning blocks 62 might be designed with a varying contact surface to better stabilize the stored articles.

Returning to FIG. 1, an illustration of top assembly 70 is included therein. Once container 10 has been constructed, and goods have been positioned therein, it may be desirable to seal container 10 and prepare it for shipping. Top assembly 70 is positioned over container 10 to close off interior storage space 45. Top assembly 70 includes a top panel 71 that is preferably constructed of multiple layer laminated corrugated material, with a plurality of attached tabs 72. Tabs 72 may be folded down to engage left and right sidewall assemblies 30 and rear wall assembly 40, and are securable in a conventional manner, completing the assembly and closure of container 10. A particular advantage of the present invention is that it allows relatively easy loading of stackable items after the shelf assemblies are secured, but before the front wall and top wall are secured. An alternative embodiment of the present invention might use a removable top or front wall assembly rather than secured panels, allowing relatively easy access to articles stored within container 10, and making the container more readily reusable. Because container 10 is constructed almost entirely of corrugated cardboard materials, it is totally recyclable.

It should be understood that the present description is for illustrative purposes only, and should not be interpreted to limit the scope of the present invention in any way. Thus, those skilled in the art will appreciate that various modifications to the disclosed embodiments might be made without departing from the intended spirit and scope of the present invention, which should be given the full breadth of the claims and any and all equivalents thereof. For example, a preferred embodiment has been illustrated as having four walls, however, the shelf assembly that is an object of the present invention might find application in three sided or many sided containers, or even as a separate stand alone shelf. As discussed above, substantial variations might be made to the number and positioning of shelf assemblies within the container, allowing goods of differing shapes and sizes to be positioned in the same container, for instance, sunroofs for different vehicle models. Further, the presently disclosed shelf assembly could find application in containers designed not for shipping, but for permanent storage or display of manufactured articles. Other objects and features of the present invention will be evident upon an examination of the attached drawing figures and appended claims.

What is claimed is:

1. A container for shipping and storing manufactured articles, said container comprising:

a container body having a base assembly and a plurality of wall assemblies, wherein each of said plurality of wall assemblies includes a wall panel with a lower edge attached to said base assembly, and at least one lateral edge joined to an adjacent wall panel;

a plurality of shelf assemblies secured to said wall assemblies and protruding into an interior of said container body, each of said plurality of shelf assemblies including at least one shelf support block and at least one shelf flap having a support surface; wherein said at least one shelf flap is attachable to said at least one shelf support block, thereby engaging the support surface with a face section located on the at least one shelf support block.

2. The shelf assembly of claim 1 wherein said support surface of said shelf flap is supported by a first face section at an end position, and by a second face section at a center position, said first and second face sections being located on separate shelf support blocks.

3. The container of claim 1 wherein said base assembly comprises a bottom panel and a plurality of blocks attached to said bottom panel, said blocks being received in a plurality of substantially complementary cut-outs in a lower face of said bottom panel.

4. The container of claim 1 further comprising a front wall assembly having a front wall panel with a plurality of attached positioning blocks, and a left and right wall flap connected to said front wall panel along a left fold line and a right fold line, respectively, said wall flaps being bendable along said fold lines to secure said front wall assembly to said container body.

5. The container of claim 4 wherein said plurality of attached positioning blocks includes two positioning blocks attached to said front wall panel and oriented in a vertical direction, said positioning blocks extending at least partially into said interior storage space to positively position articles placed therein when said front wall assembly is secured to said container body.

6. The container of claim 1 further comprising a top panel having a plurality of foldable tabs attached thereto, wherein said plurality of foldable tabs secure said top assembly to said container body.

7. A shelf assembly, comprising:

at least one shelf support block having a plurality of notches positioned along a length, wherein said plurality of notches each includes a substantially planar face region;

a panel defining a plurality of lateral slots, said lateral slots being arranged in at least two substantially parallel columns;

a foldable shelf flap having a first surface which is a support surface with a central channel, and a second surface also having a central channel;

a plurality of foldable tabs attached to said first surface and said second surface; wherein said plurality of foldable tabs are insertable through said lateral slots, thereby positioning said shelf flap such that the at least one shelf support block is at least partially positioned within the central channels such that the substantially planar face region abuts the support surface.

8. The shelf assembly of claim 7 wherein said upper and said lower surfaces of said shelf flap each have at least two foldable tabs.

9. The shelf assembly of claim 7 wherein each shelf flap has an angled anterior end face.

10. The shelf assembly of claim 7 wherein said at least one shelf support block is a plurality of shelf support blocks affixed to said panel and oriented substantially perpendicular to an orientation of said lateral slots.

11. The shelf assembly of claim 10 wherein said support surface of said shelf flap is positioned such that said shelf flap is supported by a first substantially planar face region at an end position and by a second substantially planar face region at a center position.

12. The shelf assembly of claim 7 wherein said assembly is positioned in a container for supporting and positioning articles placed therein.

13. A shipping container with an integral interior shelf assembly comprising:

a container base;

a plurality of attached wall members, each of said wall members having a bottom edge affixed to an exterior side of said container base, said container base and said wall members defining an interior cavity;

a front wall assembly having a front wall panel with at least one attached positioning block and left and right flap sections connected to said front wall panel, said left and right flap sections being securable to said container body;

at least two shelf assemblies, said at least two shelf assemblies each comprising a plurality of shelf flaps mounted to at least one shelf support block; wherein each of said plurality of shelf flaps has a planar support surface in substantially flush engagement with a face on said at least one shelf support block.

14. The shipping container of claim 13 said container has two shelf assemblies affixed to two wall members.

15. The shipping container of claim 14 further comprising a rear wall shelving system consisting of a plurality of shelf flaps partially inserted through a plurality of lateral slots in said rear wall, wherein said plurality of shelf flaps are secured to a rear wall and extend partially into an interior of said shipping container.

16. The shipping container of claim 13 wherein said container has three shelf assemblies affixed to three wall members.

17. The shipping container of claim 13 wherein said front wall assembly includes two positioning blocks placed in a substantially vertical orientation, said positioning blocks extending at least partially into said interior cavity to engage manufactured articles positioned therein.

* * * * *